US007252205B2

(12) United States Patent
Roubal et al.

(10) Patent No.: US 7,252,205 B2
(45) Date of Patent: Aug. 7, 2007

(54) PLASTIC CONTAINER WITH TOP HANDLE

(75) Inventors: Ed Roubal, Stewartstown, PA (US); Matthew Crider, York, PA (US)

(73) Assignee: Graham Packaging Company, L.P., York, PA (US)

( * ) Notice: Subject to any disclaimer, the term of this patent is extended or adjusted under 35 U.S.C. 154(b) by 592 days.

(21) Appl. No.: 10/412,336

(22) Filed: Apr. 14, 2003

(65) Prior Publication Data

US 2004/0200848 A1 Oct. 14, 2004

(51) Int. Cl.
*B65D 23/10* (2006.01)

(52) U.S. Cl. ..... 215/398

(58) Field of Classification Search ..... 215/398; 220/771

See application file for complete search history.

(56) References Cited

U.S. PATENT DOCUMENTS 4,881,652 A * 11/1989 Schiemann ..... 220/23.8
4,969,922 A * 11/1990 Platte, Sr. ..... 215/383
5,449,088 A * 9/1995 Howard et al. ..... 220/662
5,954,216 A * 9/1999 Meisner et al. ..... 215/398

* cited by examiner

*Primary Examiner*—Stephen J. Castellano
(74) *Attorney, Agent, or Firm*—Miles & Stockbridge PC

(57) ABSTRACT

A plastic container is provided. The plastic container has a base with a foundation extending upward from the base, front and rear panels, right and left side panels, a front pillar wall, and a rear pillar wall extending upward from the foundation. The front pillar and rear pillar walls are not co-planer with the front and rear panels, respectively. A transitional wall, located between the front panel and the front pillar wall and between the rear panel and the rear pillar wall, is attached to the front and rear panels and the front and rear pillar wall. The container also includes an integral handle, a top panel, a shoulder, and a finish having an opening.

25 Claims, 6 Drawing Sheets

PLASTIC CONTAINER WITH TOP HANDLE

BACKGROUND OF THE INVENTION

The invention relates to a container. More particularly, the invention relates to the structure of a container for liquids.

Recent increases in bulk purchasing have created a demand for large-size liquid containers. Many liquid products are now sold to the consuming public in plastic containers that can be as large as several liters. Larger containers that hold heavy fluids, including beverages, home products, motor oil, or the like, must have a structure strong enough to withstand several different forces. Such forces include, for example, those that result from the weight of the fluid itself, rough handling during transportation, stacking during storage, and being dropped.

A container that is commonly used as a large plastic container is the polyolefin continuous extrusion blow-molded container. Polyolefin continuous extrusion blow-molded containers provide the requisite structure to resist many forces, particularly those related to top-loading.

It will be understood that to form a polyolefin continuous extrusion blow-molded plastic container, a plastic can be heated in an extruder and a parison is created by the plastic exiting the extruder through the head tooling. The parison is then captured by a mold, and blown in the mold. Specifically, to form the cavity of the container, a parison can be extruded up into the mold and as the mold comes together, a pneumatic blow pin, for example, can pierce the parison and blow the parison up against the walls of the mold. The mold typically contains flash pockets above and below the cavity in the mold to capture the excess of the parison that is forced above and below the cavity. When the parison is blown inside the mold, it is forced into the flash pockets and portions of the parison must adhere together. The excess flash can then be cut away from the container after it is ejected from the mold.

There is a need for a large container having a structure that can withstand, in particular, the top load forces that result from stacking of multiple layers of filled containers. The structures should be capable of accommodating variations in volume of the containers' contents. Furthermore, the structure should be capable of being manufactured in conventional high-speed equipment.

SUMMARY OF THE INVENTION

The ability to withstand vertical loading on the neck finish of a container such as container 10 (referred to as top loading) is important in that it determines how many layers of containers can be stacked without causing the container to collapse or deform. A higher top load strength allows more vertical stacking of containers for shipping and storage, which can reduce shipping and storage costs. A higher top load strength also reduces the chance of deformation or rupturing due to rough handling or dropping. The invention provides a structure that has an increased top load strength compared to other structures having similar overall dimensions. Alternatively, the invention can provide a smaller container for a given top load strength.

Embodiments of the invention provide a plastic container having a base with a foundation extending upward from the base, front and rear panels, right and left side panels, a front pillar wall, and a rear pillar wall extending upward from the foundation. The front and rear pillar walls are not co-planer with the front and rear panels, respectively. A transitional wall is attached to the front and rear panels and the front and rear pillar wall. Further, the transitional wall is located between the front panel and the front pillar wall and between the rear panel and the rear pillar wall. The container also includes an integral handle with a first end attached to the right side panel and a second end attached to the transitional wall, a top panel attached to the transitional wall, front and real panels, and second end of the handle, a shoulder extending upward from the front and rear pillar walls and the left side panel, and a finish extending upward from the shoulder and having an opening.

Other embodiments of the invention provide a plastic container having a base with a foundation extending upward from the base, front and rear panels, right and left side panels, a front pillar wall, and a rear pillar wall extending upward from the foundation. The front and rear pillar walls are non-parallel with the front and rear panels, respectively. A transitional wall is attached to the front and rear panels and the front and rear pillar wall. Further, the transitional wall is located between the front panel and the front pillar wall and between the rear panel and the rear pillar wall. The container also includes an integral handle with a first end attached to the right side panel and a second end attached to the transitional wall. The handle extends downward from the second end to the first end. The container further includes a top panel attached to the transitional wall, front and real panels, and second end of the handle, a shoulder extending upward from the front and rear pillar walls and the left side panel, a finish extending upward from the shoulder and having an opening, a first chamfered corner between the right side panel and the front panel and extending upward from the base to a vertical position of the container adjacent the lower end of the handle, and a second chamfered corner between the right side panel and the front panel and extending upward from the base to a vertical position of the container adjacent the lower end of the handle.

Still other embodiments of the invention provide a plastic container having a base, a cavity having front and rear panels, right and left side panels, front and rear pillar walls and a transitional wall. The front and rear panels, right and left side panels, front and rear pillar walls and transitional wall extend upward from the base, and the transitional wall is located between the front panel and the front pillar wall and between the rear panel and the rear pillar wall. The container includes an integral handle with a first end attached to the right side panel and a second end attached to the transitional wall. The handle extends downward from the second end to the first end. The container further includes a top panel located on top of the front and rear panels and between the transitional wall and second end of the handle, a shoulder extending upward from the front and rear pillar walls and the left side panel, and a finish extending upward from the shoulder and having an opening.

BRIEF DESCRIPTION OF THE DRAWINGS

The invention is explained below in further detail with the aid of exemplary embodiments shown in the drawings, wherein.

DETAILED DESCRIPTION OF THE INVENTION

Figure 1:
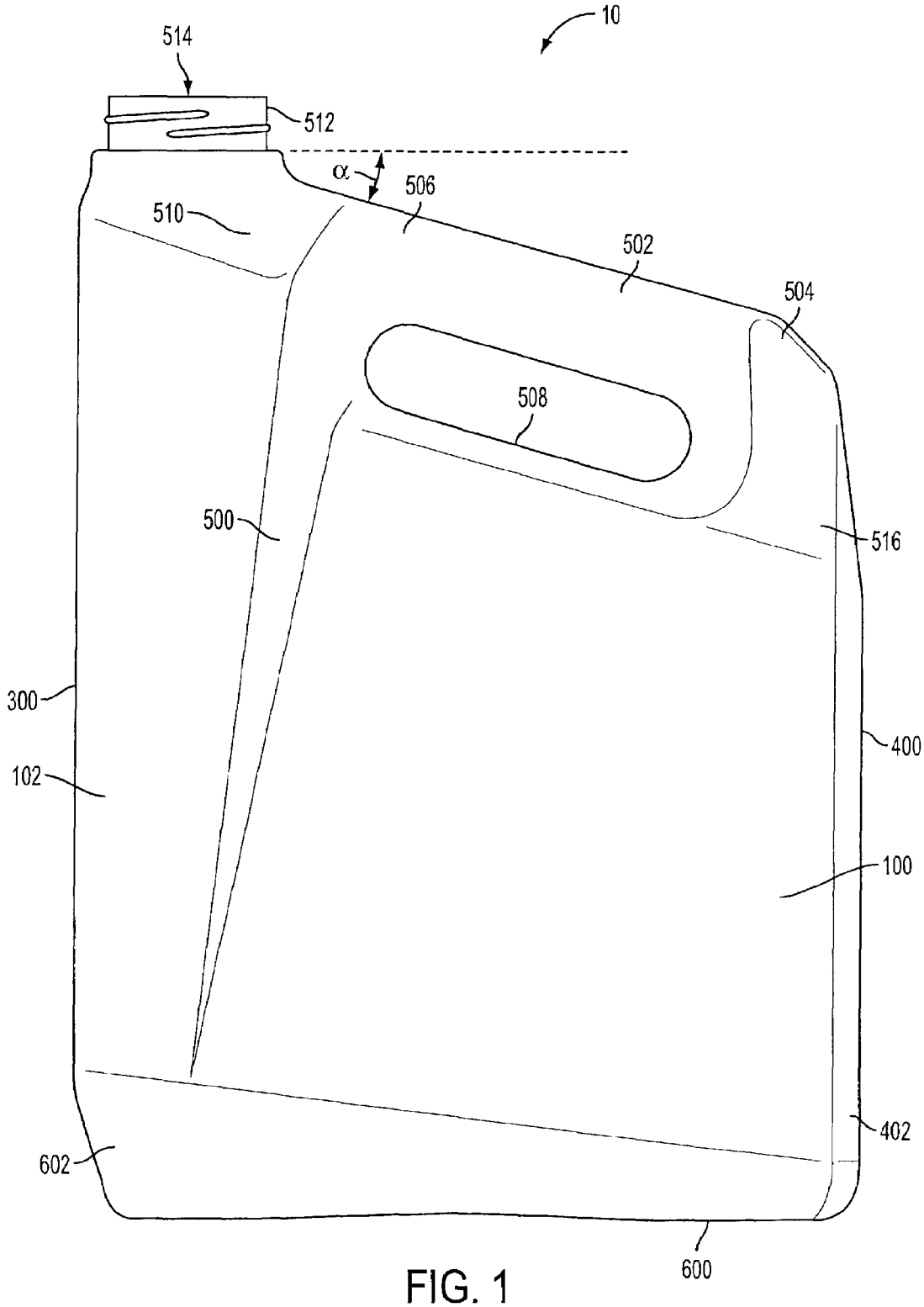
FIG. 1 is a front view of an embodiment of the invention.

The invention is explained in the following with the aid of the drawings in which like reference numbers represent like elements.

FIGS. 1-6 show a container 10 that is an example of an embodiment of the invention that can be used as a large container for liquids such as, for example, 4 or 5 liters of motor oil. Container 10 can have a base 600 connected to a foundation 602. Container 10 can also have a shoulder 510 that can be connected to foundation 602 by various panels and side walls that from a cavity and will be described in further detail below. At the upper end of shoulder 510 is a finish 512 having an opening 514. By way of example, finish 512 can be configured to receive a screw cap (not shown) for sealing container 10. A handle 502 can be provided on or near the top of container 10 to make it easier for a user to hold container 10 during transport and while pouring the contents from container 10.

The walls of the cavity of container 10 can be formed by front panel 100, rear panel 200, right side panel 400, left side panel 300, front pillar wall 102, rear pillar wall 202, transitional wall 500, and top panel 508. Front and rear panels 100, 200, front and rear pillar walls 102, 202, and right and left side panels 400, 300 can extend upward from foundation 602. Foundation 602 can extend downward from the walls of the cavity of container 10 towards base 600 and can taper towards base 600 from the point where it connects with the walls of the cavity of container 10 to the point where it merges with base 600.

Front and rear panels 100, 200 can be connected to right side panel 400 top panel 508, transitional wall 500 and angled sides 516, 518 of a lower end 504 of handle 502. Front and rear panels can be positioned substantially opposite from each other and extend substantially parallel to each other. In a preferred embodiment, front and rear panels 100, 200 do not join right side panels at 90° corners, but, instead, chamfered corners 402, 404 are provided. Front and rear panels 100, 200 can blend into top panel 508, transitional wall 500 and the lower end 504 of handle 502 via the use of gentle curves so as to form a contiguous piece of plastic.

Front and rear pillar walls 102, 202 can be connected to left side wall 300, transitional wall 500 and shoulder 510. Front and rear pillar walls 102, 202 can be positioned substantially opposite each other. Front and rear pillar walls 102, 202 can taper towards left side wall 300 causing the distance between front and rear pillar walls 102, 202 at the point where they merge with transitional wall 500 to be greater than the distance between the two walls at the point where they merge with left side panel 300. Front and rear pillar walls 102, 202 can also be non-parallel to front and rear panels 100, 200. In this example, because the front and rear pillar walls 102, 202 are non-parallel to front and rear panels 100, 200, transitional wall 500 has a non-rectangular shape.

Figure 2:
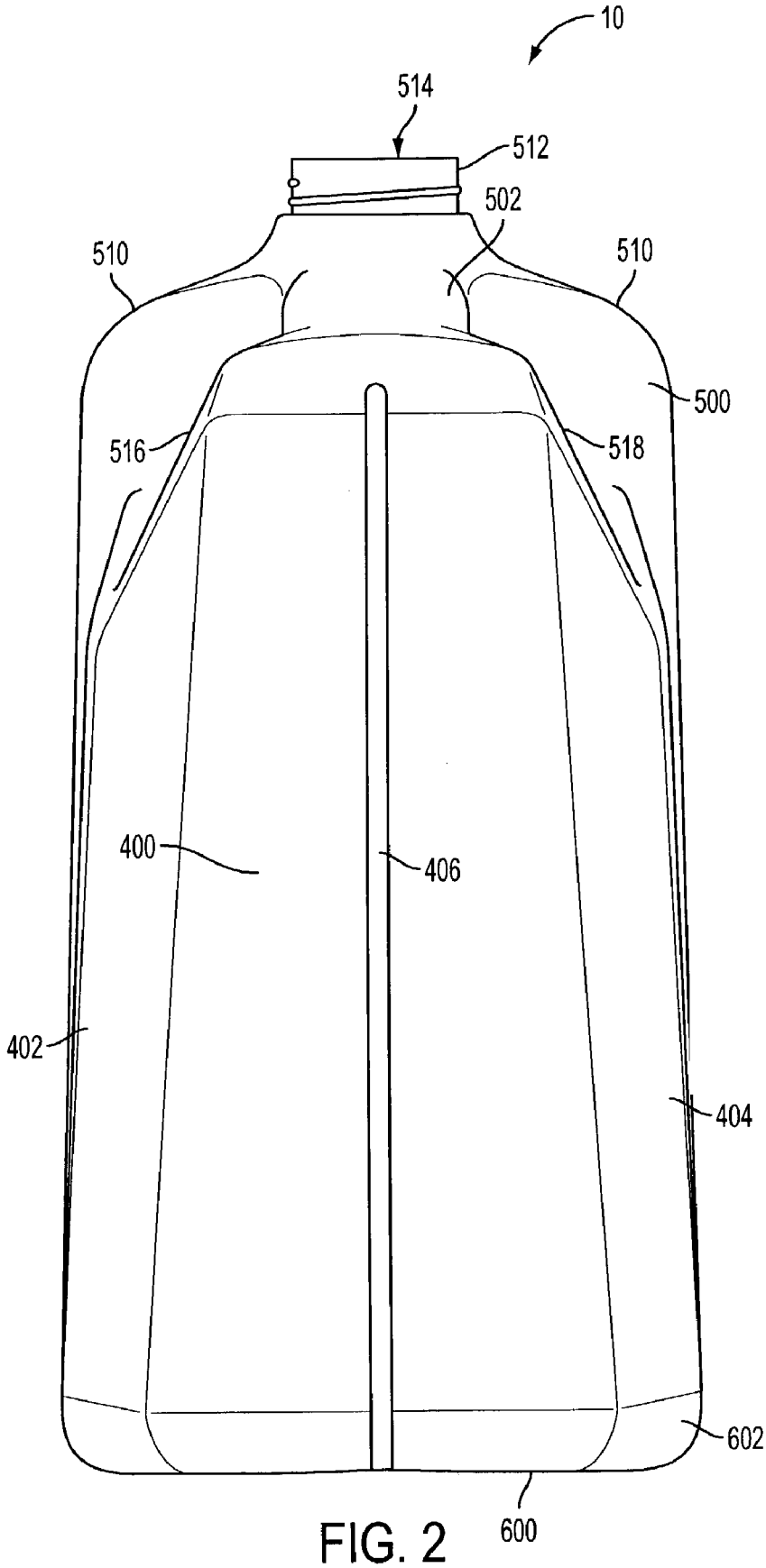
FIG. 2 is a right side view of an embodiment of the invention.

As shown in FIG. 2, a front portion of transitional wall 500 can extend from the foundation between front panel 100 and front pillar wall 102 along the edges of front panel 100 and front pillar wall 102 where it can merge with the front side of shoulder 510, top panel 508 and an upper end 506 of handle 502. Transitional wall 500 can then extend between the edges of the front side of shoulder 510 and top panel 508 under handle 502 where it meets the rear portion of transitional wall 500. The rear portion of transitional wall 500 can extend from the foundation between rear panel 200 and rear pillar wall 202 along the edges of rear panel 200 and front pillar wall 202 where it can merge with the rear side of shoulder 510, top panel 508 and the upper end 506 of handle 502. Transitional wall 500 can then extend between the edges of the rear side of shoulder 510 and top panel 508 under handle 502 where transitional wall 500 meets the front portion.

Figure 3:
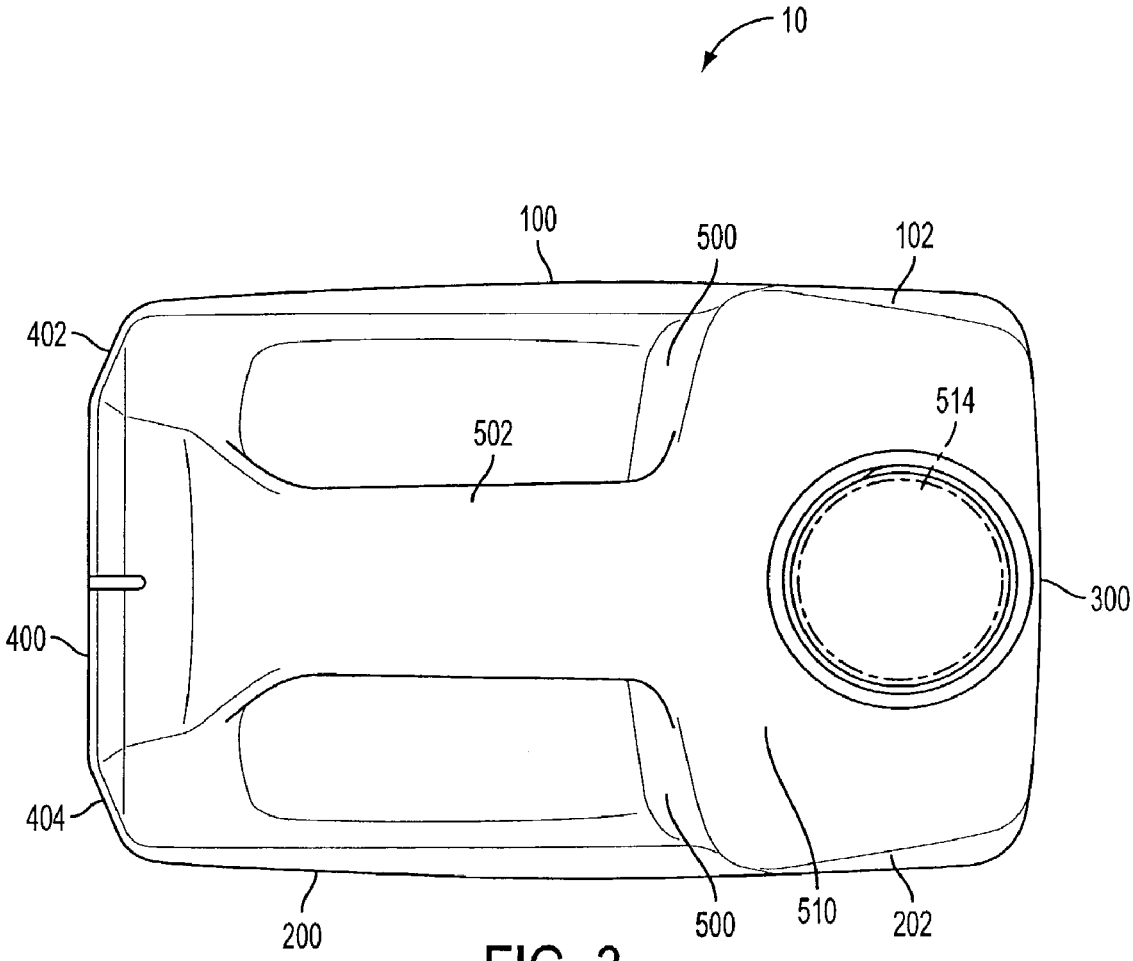
FIG. 3 is top view of an embodiment of the invention.
Figure 4:
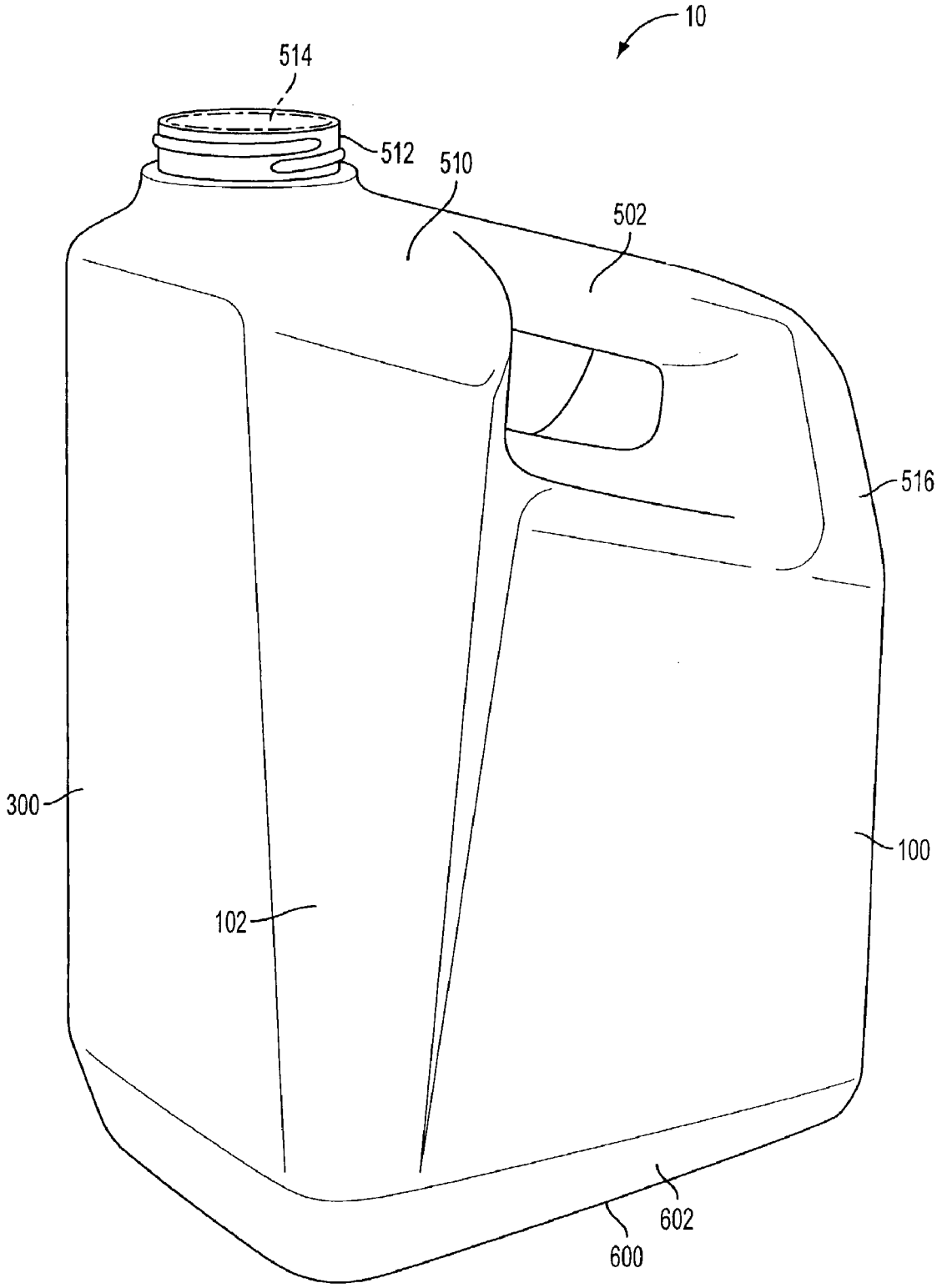
FIG. 4 is a perspective view of an embodiment of the invention.

FIG. 3 illustrates how the top of container 10 can be formed to afford easy pouring. Shoulder 510 can be connected to front and rear pillar walls 102, 202, left side wall 300, and upper end 506 of handle 502. The transition from front and rear pillar walls 102, 202, left side wall 300, and transitional wall 500 to shoulder 510 can be formed by gentle curves. Shoulder 510 can extend upwardly to threaded finish 512. The finish defines an opening 514 through which container 10 is filled with fluid and through which the fluid is subsequently dispensed. The finish 512 and opening 514 can be centrally oriented between the front and rear pillar walls 102, 202, and can also be positioned closed to left side wall 300 than the upper end 506 of handle 502. A load placed on container 10 will be evenly distributed by shoulder 510, thereby resisting unwanted deformations. However, finish 512 can alternatively be located off-center as long as the remaining structure is sufficient to withstand the required top-loading.

As shown in FIG. 3, handle 502 can be provided to make it easier for a user to hold container 10 during transport and while pouring the contents from container 10. Handle 502 can have upper and lower ends 506, 504. Upper end 506 of handle 502 can merge with shoulder 510 and transitional wall 500. Lower end 504 of handle 502 can merge with right side panel 400 and front and rear panels 100, 200. Handle 502 can be tubular to receive fluid, especially as the fluid is poured from container 10.

Upper end 506 of handle 502 can be positioned at a higher elevation than lower end 504 of handle 502. To this end, handle 502 can extend at an angle downward from upper end 506 to lower end 504. As shown in FIG. 1, angle $\alpha$ represents the angle at which handle 502 can extend downward. For example, angle $\alpha$ can be anywhere from 0° from the horizontal to 45° from the horizontal. In another exemplary embodiment, angle $\alpha$ can be anywhere from 0° to 35° from the horizontal. In yet another exemplary embodiment, angle $\alpha$ can be anywhere from 0° to 25° from the horizontal. Still, in yet another exemplary embodiment, angle $\alpha$ can be anywhere from 0° to 15° from the horizontal. Finally, in another exemplary embodiment, angle $\alpha$ can be approximately 15° from the horizontal.

Figure 5:
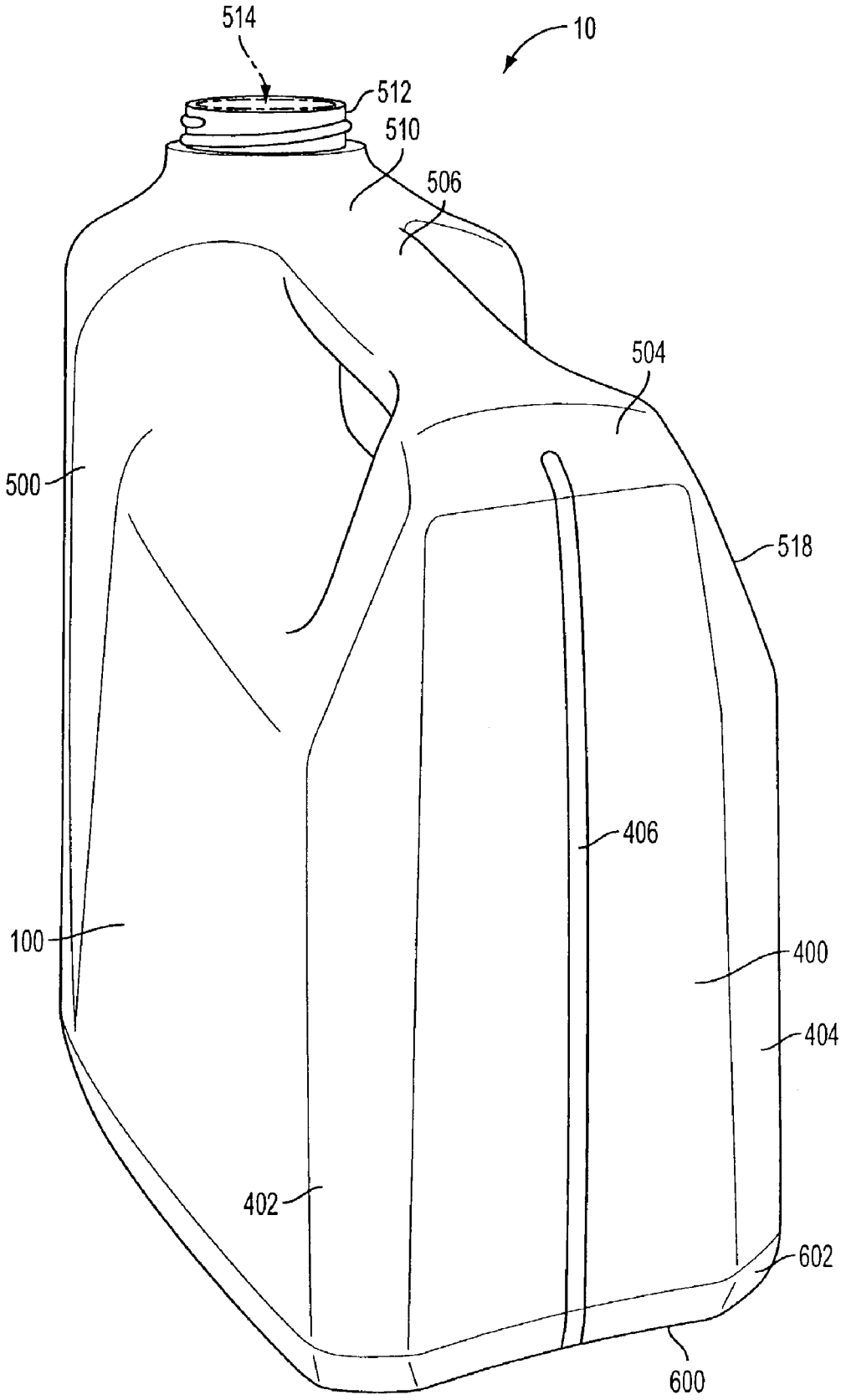
FIG. 5 is a perspective view of an embodiment of the invention.

As described above, lower end 504 of handle 502 can merge with right side panel 400. FIGS. 2 and 5 illustrate how right side panel 400 can merge with lower end 504 of handle 502 and front and rear panels 100, 200. Chamfered corners 402, 404 can be provided to connect right side panel 400 with front and rear panels 100, 200. Chamfered corners can terminate around the lower end 504 of handle 502. Additionally, lower end 504 of handle 502 can have angled sides 516, 518 to merge with front and rear panels 100, 200 and chamfered corners 402, 404. Right side panel 400 can have a view stripe 406 and indicia (not shown) to allow a consumer to pour a measured amount of fluid, or to determine the amount of fluid remaining in container 10.

Figure 6:
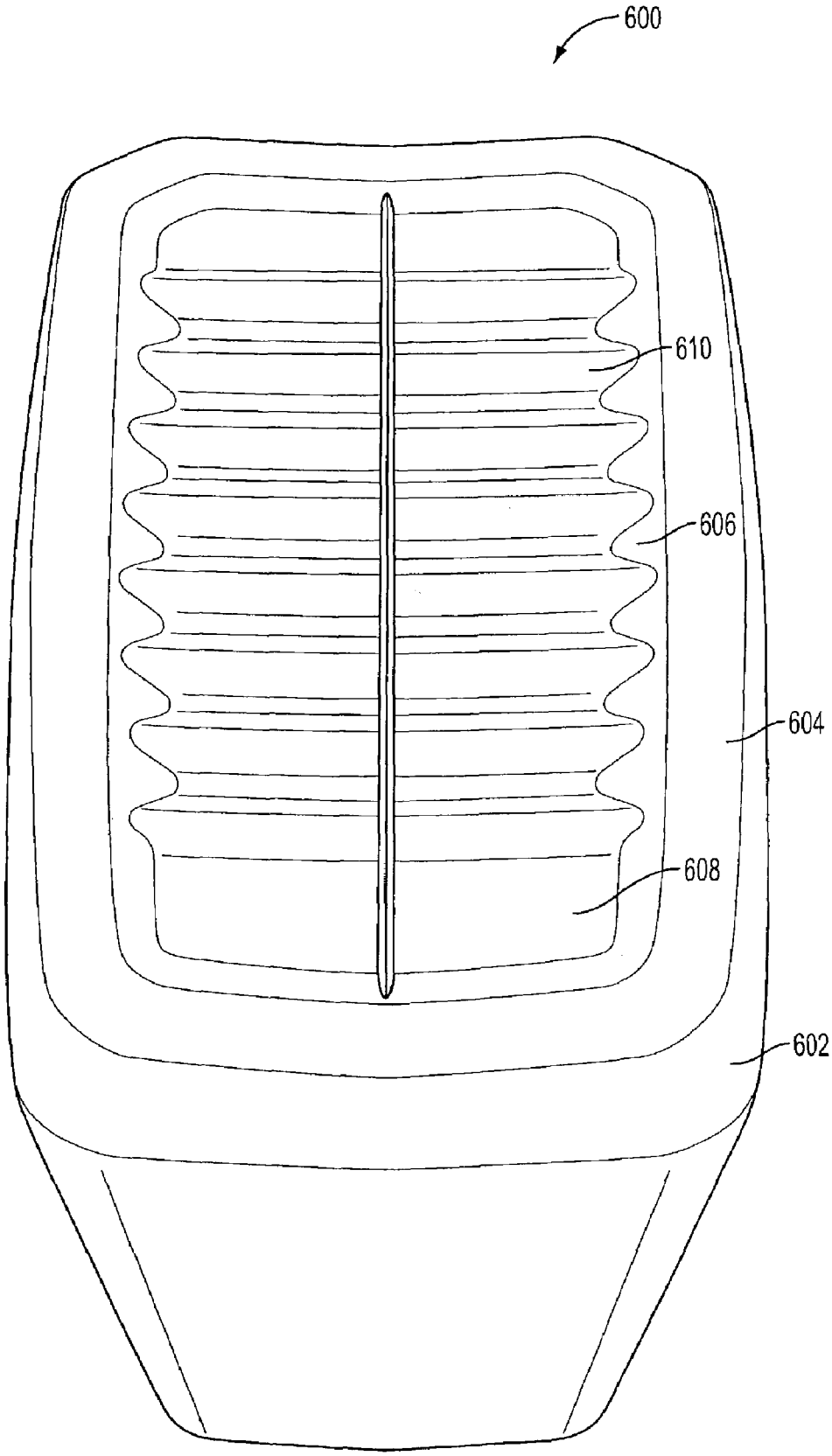
FIG. 6 is a perspective view from the bottom of an embodiment of the invention.

FIG. 6 shows an example of the structure of base 600. At base 600, foundation 602 can transition into a contact area 604. Contact area 604 can be connected to a substantially planar base panel 608 by a transition 606. Contact area 604 can be designed such that all points of contact area 604 contact a support surface on which container 10 is placed. Alternatively, some portion less than all points of contact area 604 can contact the support surface. A number of corrugations (ribs) 610 (in this example seven) provide structural rigidity to base panel 608. FIG. 6 shows only one example of base 600. It is noted that other base structures can be used as long as the structures are sufficiently strong to support the contents of container 10 while preventing unacceptable sagging.

By way of example, and not by way of limitation, a preferred container 10 can have about a 4-5 liter capacity and be made from high-density polyethylene (HDPE). A vertical load experienced by finish 512 of container 10 is predominantly transferred to base 600 through five structural paths. The portion of the load carried by the left side of container 10 is transferred mainly through transitional wall 500 and along left side panel 300. The pillar walls 102, 202 and transitional wall 500 can provide added strength to container 10 if handle 502 extends downward at a smaller angle $\alpha$. Additionally, a handle that extends downward at a smaller angle $\alpha$ allows for the capacity of the cavity of container 10 to increase. Thus, for a given capacity, the overall dimensions for a container can be reduced by reducing the angle $\alpha$ at which handle 502 extends downward.

The portion of the load carried by the right side of container 10 is transferred mainly through handle 502 and then through chamfered corners 402, 404. However, in the event that handle 502 extends downward at a small angle $\alpha$, additional structure may be necessary to meet top-loading requirements. The combination of pillar walls 102, 202 and transition wall 500 with handle 502 extending downward at angle $\alpha$ may provide the requisite top-loading support. Additionally, using chamfered corners 402, 404 instead of normal rounded corners provides stronger corners and, as a result, increased top load strength. Finally, transitional wall 500 and front and rear pillar walls 102, 202 may actually compensate for a smaller angle $\alpha$ at which handle 502 extends downward.

The invention has been described in detail with respect to preferred embodiments and it will now be apparent from the foregoing to those skilled in the art that changes and modifications may be made without departing from the invention in its broader aspects. The invention, therefore, is intended to cover all such changes and modifications that fall within the true spirit of the invention.

What is claimed is:

1. A plastic container, comprising:

a base;

a foundation extending upward from the base;

front and rear panels extending upward from the foundation;

right and left side panels extending upward from the foundation;

a front pillar wall extending upward from the foundation, the front pillar wall being non-co-planer with the front panel;

a rear pillar wall extending upward from the foundation, the rear pillar wall being non-co-planer with the rear panel;

a transitional wall attached to the front and rear panels and the front and rear pillar walls, the transitional wall being located between the front panel and the front pillar wall and being located between the rear panel and the rear pillar wall;

an integral handle having a first end attached to the right side panel and a second end attached to the transitional wall;

a top panel attached to the transitional wall, front and real panels, and second end of the handle;

a shoulder extending upward from the front and rear pillar walls and the left side panel; and a finish extending upward from the shoulder and having an opening.

2. The container according to claim 1, further comprising a first chamfered corner between the right side panel and the front panel and extending upward from the base to a vertical position of the container adjacent the lower end of the handle; and a second chamfered corner between the right side panel and the rear panel and extending upward from the base to a vertical position of the container adjacent the lower end of the handle.

3. The container according to claim 1, wherein the front pillar wall and the front panel are non-parallel, and the rear pillar wall and rear panel are non-parallel.

4. The container according to claim 1, wherein the top panel extends in a direction substantially parallel to the handle.

5. The container according to claim 1, wherein the front and rear panels are substantially parallel; and wherein the right and left side panels are substantially parallel.

6. The container according to claim 1, wherein the front and rear pillar walls taper toward the left side panel.

7. The container according to claim 1, wherein the foundation tapers toward the base.

8. The container according to claim 1, wherein the handle extends downward from the second end to the first end.

9. The container according to claim 8, wherein the handle extends downward from the second end to the first end at an angle between 0 and 25 degrees from horizontal.

10. The container according to claim 9, wherein the handle extends downward from the second end to the first end at an angle between 0 and 15 degrees from horizontal.

11. The container according to claim 10, wherein the handle extends downward from the second end to the first end at an angle of 15 degrees from horizontal.

12. The container according to claim 1 further comprising a view stripe.

13. The container according to claim 1, wherein the handle is tubular.

14. The container according to claim 1, wherein the base comprises:

at least one contact region for contacting a support surface on which the container can be supported; and a plurality of strengthening ribs.

15. The container according to claim 14, wherein the plurality of strengthening ribs are parallel to each other.

16. The container according to claim 1, wherein the container is a 4.0 liter liquid container.

17. The container according to claim 1, wherein the container is a 5.0 liter liquid container.

18. A plastic container, comprising:

a base;

a foundation extending upward from the base;

front and rear panels extending upward from the foundation;

right and left side panels extending upward from the foundation;

a front pillar wall extending upward from the foundation, the front pillar wall being non-parallel to the front panel;

a rear pillar wall extending upward from the foundation, the rear pillar wall being non-parallel to the rear panel;

a transitional wall attached to the front and rear panels and the front and rear pillar walls, the transitional wall being located between the front panel and the front pillar wall and being located between the rear panel and the rear pillar wall;

an integral handle having a first end attached to the right side panel and a second end attached to the transitional wall, the handle extending downward from the second end to the first end;

a top panel attached to the transitional wall, front and real panels, and second end of the handle;

a shoulder extending upward from the front and rear pillar walls and the left side panel;

a finish extending upward from the shoulder and having an opening;

a first chamfered corner between the right side panel and the front panel and extending upward from the base to a vertical position of the container adjacent the lower end of the handle; and a second chamfered corner between the right side panel and the rear panel and extending upward from the base to a vertical position of the container adjacent the lower end of the handle.

19. The container according to claim 18, wherein the handle extends downward from the second end to the first end at an angle between 0 and 25 degrees from horizontal.

20. The container according to claim 19, wherein the handle extends downward from the second end to the first end at an angle between 0 and 15 degrees from horizontal.

21. The container according to claim 20, wherein the handle extends downward from the second end to the first end at an angle of 15 degrees from horizontal.

22. A plastic container, comprising:

a base;

a cavity having front and rear panels, right and left side panels, front and rear pillar walls and a transitional wall, the front and rear panels, right and left side panels, front and rear pillar walls and transitional wall extending upward from the base, and the transitional wall being located between the front panel and the front pillar wall and between the rear panel and the rear pillar wall;

an integral handle having a first end attached to the right side panel and a second end attached to the transitional wall, the handle extending downward from the second end to the first end;

a top panel located on top of the front and rear panels and between the transitional wall and second end of the handle;

a shoulder extending upward from the front and rear pillar walls and the left side panel; and a finish extending upward from the shoulder and having an opening.

23. The container according to claim 22, wherein the handle extends downward from the second end to the first end at an angle between 0 and 25 degrees from horizontal.

24. The container according to claim 23, wherein the handle extends downward from the second end to the first end at an angle between 0 and 15 degrees from horizontal.

25. The container according to claim 24, wherein the handle extends downward from the second end to the first end at an angle of 15 degrees from horizontal.

* * * * *